US009298952B2

(12) United States Patent
Al-Absi et al.

(10) Patent No.: US 9,298,952 B2
(45) Date of Patent: Mar. 29, 2016

(54) CMOS LOGARITHMIC CURRENT GENERATOR AND METHOD FOR GENERATING A LOGARITHMIC CURRENT

(71) Applicant: KING FAHD UNIVERSITY OF PETROLEUM AND MINERALS, Dhahran (SA)

(72) Inventors: Munir A. Al-Absi, Dhahran (SA); Karama M. Al-Tamimi, Dhahran (SA)

(73) Assignee: King Fahd University of Petroleum and Minerals, Dhahran (SA)

( * ) Notice: Subject to any disclaimer, the term of this patent is extended or adjusted under 35 U.S.C. 154(b) by 243 days.

(21) Appl. No.: 14/083,113

(22) Filed: Nov. 18, 2013

(65) Prior Publication Data

US 2015/0137868 A1 May 21, 2015

(51) Int. Cl.
*G06G 7/24* (2006.01)

(52) U.S. Cl.
CPC ..... *G06G 7/24* (2013.01)

(58) Field of Classification Search
CPC ..... G06G 7/24
USPC ..... 327/345–352, 103
See application file for complete search history.

(56) References Cited

U.S. PATENT DOCUMENTS 4,990,803 A 2/1991 Gilbert
5,012,140 A 4/1991 Bateman
7,342,451 B2 3/2008 Brueske
7,737,759 B2 * 6/2010 Gaeta ..... H03G 7/06 327/352
8,305,134 B2 11/2012 Hirose et al.
8,779,833 B2 * 7/2014 Al-Tamimi ..... H03F 3/45183 327/350

FOREIGN PATENT DOCUMENTS

GB 1 421 736 1/1976
JP 3-99508 4/1991

OTHER PUBLICATIONS

Kumngern, M., Chanwutitum, J., Dehan, K., "Simple CMOS current-mode exponential function generator circuit," 5th International Conference Electrical Engineering/Electronics, Computer, Telecommunications and Information Technology, vol. 2, pp. 709-712, May 14-17, 2008 (Abstract only).
A. Ghanaatian-Jahromi, A. Abrishamifar, A. Medi, "A Novel Voltage-to-Voltage Logarithmic Converter with High Accuracy," Journal of Selected Areas in Microelectronics, No. 01, pp. 1-4, 2011.
Huang C., Chakrabartty, S., "Current-input current-output CMOS logarithmic amplifier based on translinear Ohm's law," Electronics Letters, vol. 47, No. 7, pp. 433-434, Mar. 2011.
(Continued)

*Primary Examiner* — Dinh Le
(74) *Attorney, Agent, or Firm* — Richard C. Litman

(57) ABSTRACT

A CMOS logarithmic current generator includes current mode circuitry having a design principle based on a Taylor's series expansion that approximates an exponential function. A MOSFET circuit provides a function generator core cell having a biasing current $I_b$. The FETs of the circuit are matched and are biased in the weak inversion region. Additional transistors are used to convert a pair of input currents to a pair of voltages to provide an output current based upon a current mode logarithmic function. The biasing current $I_b$ can be varied to provide a variable gain in the circuit.

14 Claims, 7 Drawing Sheets

(56) References Cited

OTHER PUBLICATIONS

Karimi, Y., Abrishamifar, A., "A low power configurable analogue block," 19th Iranian Conference on Electrical Engineering (ICEE), pp. 1-5, May 17-19, 2011 (Abstract only).
Motamed, A., Hwang, C., Ismail, M., "A low-voltage low-power wide-range CMOS variable gain amplifier," Transactions on Circuits and Systems II: Analog and Digital Signal Processing, IEEE, vol. 45, No. 7, pp. 800-811, Jul. 1998 (Abstract only).
Pope, C., "CMOS logarithmic curvature-corrected voltage reference using a multiple differential structure," International Symposium on Signals, Circuits and Systems, vol. 2, pp. 413-416, Jul. 14-15, 2005 (Abstract Only).
Quoc-Hoang Duong, Trung-Kien Nguyen, Sang-Gug Lee, "Low-voltage low-power high dB-Linear CMOS exponential function generator using highly-linear V-I converter," Proceedings of the 2003 International Symposium on Low Power Electronics and Design, pp. 349-352, Aug. 25-27, 2003 (Abstract only).
Torteanchai, U., Kumngern, M., Dejhan, K., "A CMOS log-antilog current multiplier/divider circuit using DDCC," TENCON 2011—2011 IEEE Region 10 Conference, pp. 634-637, Nov. 21-24, 2011 (Abstract only).
Al-Tamimi, K.M., Al-Absi, M.A., "CMOS logarithmic current generator," 2012 IEEE Student Conference on Research and Development (SCOReD), pp. 67-71, Dec. 5-6, 2012 (Abstract only).

* cited by examiner

CMOS LOGARITHMIC CURRENT GENERATOR AND METHOD FOR GENERATING A LOGARITHMIC CURRENT

BACKGROUND OF THE INVENTION

1. Field of the Invention

The present invention relates to current mode electronic circuitry, and particularly to a complimentary metal-oxide semiconductor (CMOS) logarithmic current generator.

2. Description of the Related Art

A logarithmic function is a non-linear function in which the output is proportional to the logarithm of the input. The circuits performing such a function are typically widely used in many applications, these include but are not limited to medical equipment, instrumentation, telecommunication, active filters, disk drives and neural networks, for example.

Many approaches to the design of a logarithmic circuit have been reported in the literature. An existing type of CMOS current-mode logarithmic circuit produces the logarithmic of an input greater than unity and generally has a limited dynamic range. In addition, typically an existing type of CMOS current-mode logarithmic circuit has relatively no gain controllability and uses some passive elements. Other realizations of an existing type of CMOS current-mode logarithmic circuit typically have at least one of the following drawbacks. These drawbacks include, for example, absence of low voltage operation capability, a limited dynamic range, employment of bipolar junction transistor (BJT) transistors, does not enjoy a current-mode, cannot realize a true logarithmic function circuit where the ratio is larger or smaller than unity, temperature dependent, relatively high power consumption, generally no controllability, and, to some extent, linearity error is high, use passive elements, i.e. resistors, and general complexity of the circuit.

Thus, a CMOS logarithmic current generator addressing the aforementioned problems is desired.

SUMMARY OF THE INVENTION

The CMOS logarithmic current generator includes current mode circuitry having a design principle based on Taylor's series expansion that approximates an exponential function. A metal-oxide semiconductor field-effect transistor (MOSFET) circuit provides a function generator core cell having a current $I_b$. The field effect transistors (FETs) of the circuit are matched and are biased in the weak inversion region. Additional transistors are used to convert a pair of input currents to a pair of voltages in logarithmic form to provide a current mode logarithmic function. The current $I_b$ can be varied to provide variable gain in the circuit.

These and other features of the present invention will become readily apparent upon further review of the following specification and drawings.

BRIEF DESCRIPTION OF THE DRAWINGS

Unless otherwise indicated, similar reference characters denote corresponding features consistently throughout the attached drawings.

DETAILED DESCRIPTION OF THE PREFERRED EMBODIMENTS

Figure 1:
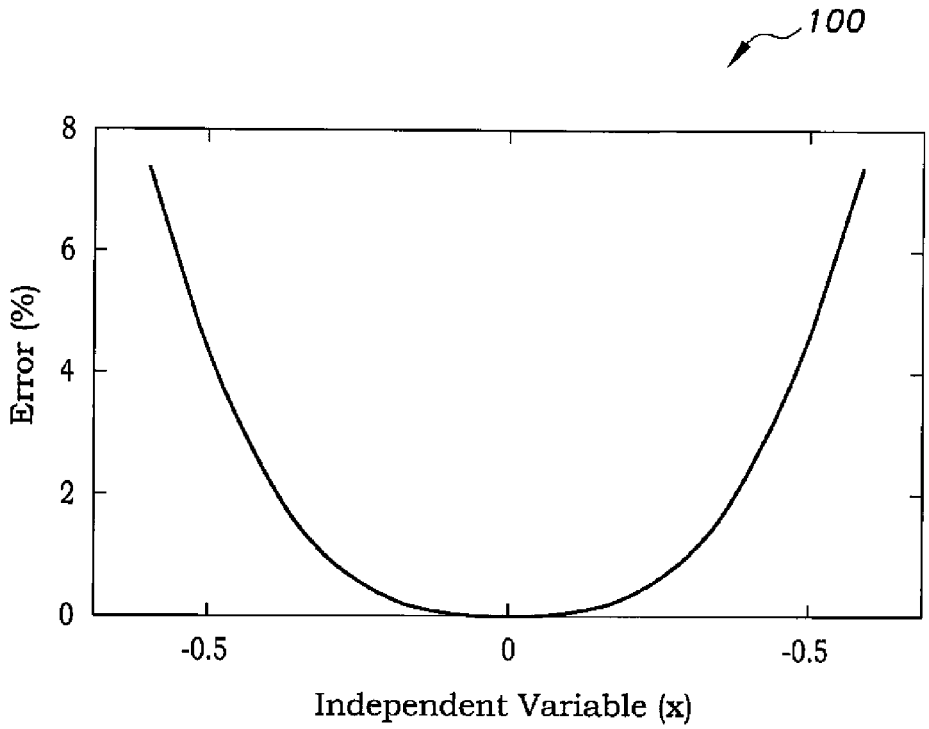
FIG. 1 is a plot of the error between $e^x - e^{-x}$ and 2x.

Embodiments of a CMOS logarithmic current generator include current mode circuitry having a design principle based on a Taylor's series expansion that approximates an exponential function, the approximation being characterized by the relation:

$$e^x = 1 + x + \frac{x^2}{2!} + \frac{x^3}{3!} + \ldots + \frac{x^n}{n!} + \ldots, \tag{1}$$

where x is the independent variable and if x is much smaller than one (x<<1), then the higher order terms in the Taylor's series approximation become negligible and relation (1) can be written as:

$$e^x \approx 1 + x + \frac{x^2}{2!} \text{ for } x \ll 1. \tag{2}$$

According to relation (2), $e^{-x}$ can be written as:

$$e^{-x} \approx 1 - x + \frac{x^2}{2!}. \tag{3}$$

From relations (2) and (3) it can be shown that:

$$e^x - e^{-x} \approx 2x. \tag{4}$$

Figure 2:
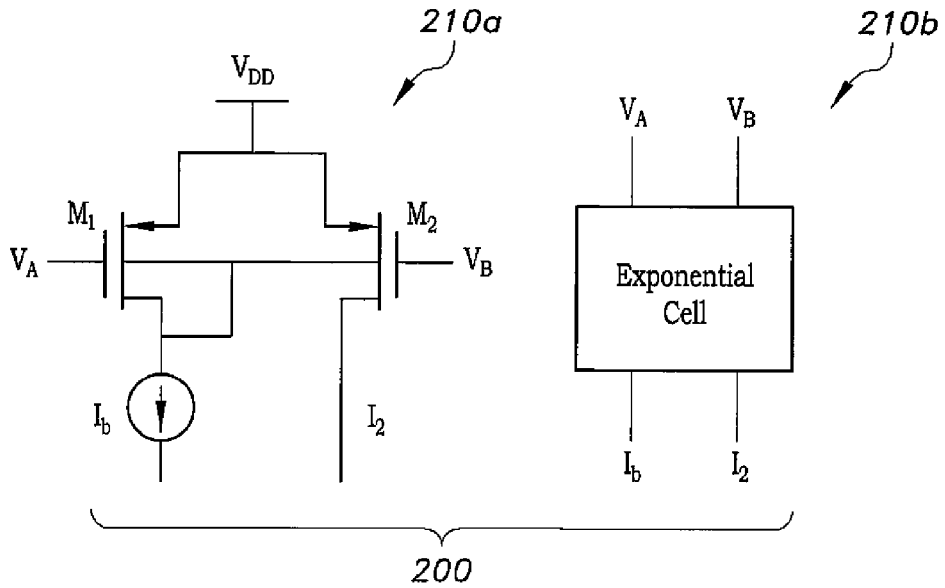
FIG. 2 is a circuit diagram and block equivalent of a basic exponential function circuit used in embodiments of a CMOS logarithmic current generator according to the present invention.

The error between $e^x - e^{-x}$ and 2x is plotted in FIG. 1. The error can be less than 0.1% while the input |x|<0.2. As shown in FIG. 2, the exemplary basic exponential function circuit 200 has a MOSFET circuit 210*a* providing function generator core cell 210*b* with a current $I_b$. Assuming that the FETs, such as FETS M1 and M2 of 210*a* are relatively perfectly matched and both are biased in the weak inversion region, the I-V characteristics of the MOSFET in weak inversion is given by:

$$I_b = I_{D0} \cdot \exp\left[\frac{(V_{DD} - V_A) + (n-1)V_{BS}}{nU_T}\right] \text{ and} \tag{5}$$

$$I_2 = I_{D0} \cdot \exp\left[\frac{(V_{DD} - V_B) + (n-1)V_{BS}}{nU_T}\right], \tag{6}$$

where $$I_{D0} = 2n\mu_n C_{ox} U_T^2 \frac{W}{L}$$

is the leakage current, n is the weak inversion slope factor, $\mu_n$ is the mobility of charge carriers $$\frac{cm^2}{V.s},$$

$C_{ox}$ is the normalized oxide capacitance, capacitor per unit gate area $$\frac{F}{m^2},$$

$V_{BS}$ is the body-source voltage of M1 and M2, and $U_T$=KbT/q is the thermal voltage, Kb is Boltzmann's constant ($1.38*10^{-23}$ J/K), T is temperature in degrees Kelvin (K), and q is charge of an electron ($1.6*10^{-19}$ coulombs(C)). Combining relations (5) and (6) provides:

$$I_2 = I_b \cdot \exp\left[\frac{(V_A - V_B)}{nU_T}\right]. \tag{7}$$

Figure 3:
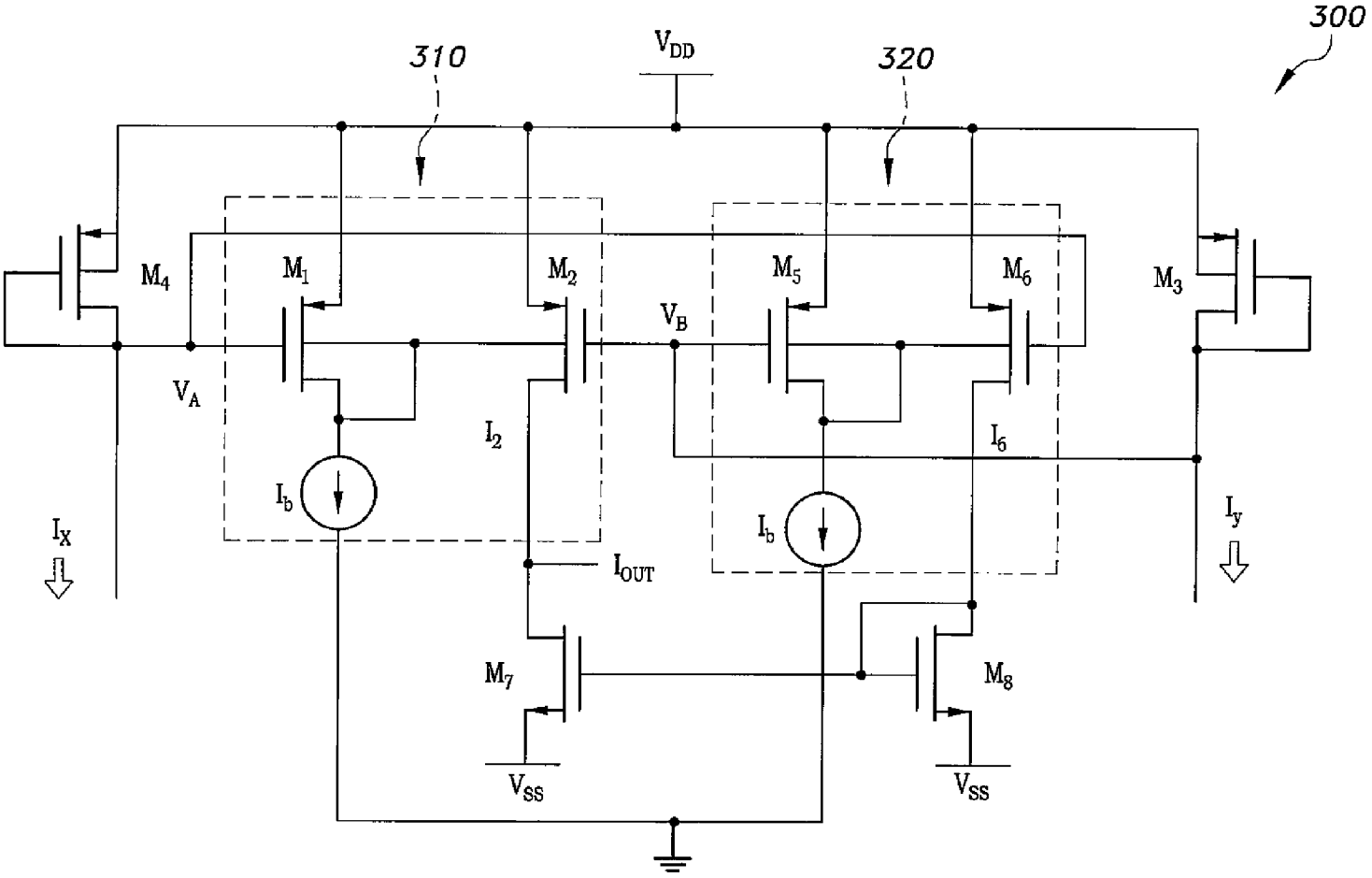
FIG. 3 is a circuit diagram of an embodiment of a CMOS logarithmic current generator circuit according to the present invention.

Referring now to FIG. 3, there is illustrated a circuit diagram of an embodiment of a CMOS logarithmic current generator circuit 300. The CMOS logarithmic current generator 300 illustrates a plurality of transistors, such as MOSFETS, namely MOSFETS M1 through M8, for example. In the CMOS logarithmic current generator circuit 300, a first metal-oxide semiconductor field-effect transistor (MOSFET) M1 and a second MOSFET M2 are matched with each other and configured in the (CMOS) logarithmic current generator circuit 300 as a first MOSFET pair biased in a weak inversion region to provide a first function generator core cell 310.

Also, in the CMOS logarithmic current generator circuit 300, a third MOSFET M5 and a fourth MOSFET M6 are matched with each other and configured in the CMOS logarithmic current generator circuit 300 as a second MOSFET pair biased in a weak inversion region to provide a second function generator core cell 320. A fifth MOSFET M7 is connected to a source voltage $V_{SS}$ and the first function generator core cell 310, the fifth MOSFET M7 contributing to an output current $I_{out}$ of the CMOS logarithmic current generator circuit 300. A sixth MOSFET M8 connected to the source voltage $V_{SS}$ and the second function generator core cell 320, the sixth MOSFET M8 contributing to the output current $I_{out}$ of the CMOS logarithmic current generator circuit 300.

Also, in the CMOS logarithmic current generator 300, a seventh MOSFET M4 is in operable communication with the first function generator core cell 310, the seventh MOSFET M4 providing an input current $I_X$ to the CMOS logarithmic current generator circuit 300 to convert an input current $I_X$ to a first voltage $V_A$. An eighth MOSFET M3 in operable is communication with the second function generator core cell 320, the eighth MOSFET M3 providing an input current $I_Y$ to the CMOS logarithmic current generator circuit 300 to convert the input current $I_Y$ to a second voltage $V_B$.

Further, the first function generator core cell 310 and the second function generator core cell 320 have a biasing current $I_b$ that varies based upon the first voltage $V_A$ and the second voltage $V_B$ applied to the first function generator core cell 310 and the second function generator core cell 320, the first voltage $V_A$ being determined by the input current $I_X$ and the second voltage $V_B$ being determined by the input current $I_Y$, and the CMOS logarithmic current generator circuit 300 provides the output current $I_{out}$ based upon a current mode logarithmic function defined by the relation:

$$I_{out} = 2I_b \cdot \ln\left(\frac{I_Y}{I_X}\right). \tag{7A}$$

The drain current of transistors M2 and M6 are given by relations (8) and (9), respectively:

$$I_2 = I_b \cdot \exp\left[\frac{(V_A - V_B)}{nU_T}\right], \text{ and} \tag{8}$$

$$I_6 = I_b \cdot \exp\left[\frac{(V_B - V_A)}{nU_T}\right]. \tag{9}$$

Equation relation (9) can be rewritten as:

$$I_6 = I_b \cdot \exp\left[\frac{-(V_A - V_B)}{nU_T}\right]. \tag{10}$$

The drain current for transistor M8 is the same as the drain current of M6 and, therefore:

$$I_{out}=I_2-I_8=I_2-I_6. \tag{11}$$

Combining relations (8), (10) and (11), the output current is given by:

$$I_{out} = I_b\left[\exp\left[\frac{(V_A - V_B)}{nU_T}\right] - \exp\left[\frac{-(V_A - V_B)}{nU_T}\right]\right]. \tag{12}$$

Using relation (4) and with the quantity $$\left[\frac{(V_A - V_B)}{nU_T}\right] \ll 1,$$

then relation (12) can be written as:

$$I_{out} = 2I_b \cdot \left[\frac{(V_A - V_B)}{nU_T}\right]. \tag{13}$$

Transistors M3 and M4 are used to convert the input currents $I_y$ and $I_x$ to voltages $V_B$ and $V_A$, respectively, in logarithmic form as shown in relations (14) and (15):

$$V_A = V_{DD} - V_{sg4} = V_{DD} - nU_T \ln\left(\frac{I_X}{I_{Do}}\right), \tag{14}$$

and $$V_B = V_{DD} - V_{sg3} = V_{DD} - nU_T \ln\left(\frac{I_Y}{I_{Do}}\right). \tag{15}$$

Combining relations (15) and (14) provides:

$$\left[\frac{(V_A - V_B)}{nU_T}\right] = \ln\left(\frac{I_Y}{I_X}\right). \tag{16}$$

Combining relations (16) and (13), the output current $I_{out}$ is given by:

$$I_{out} = 2I_b \cdot \ln\left(\frac{I_Y}{I_X}\right). \tag{17}$$

Relation (17) is a current-mode logarithmic function. Keeping the current $I_X$ constant or substantially constant provides a means for controlling a gain of the output current $I_{out}$ by the bias current $I_b$ and a means for implementing the output current $I_{out}$ as being proportional to the logarithm of $I_Y$. Also, keeping the current $I_Y$ constant or substantially constant provides a means for implementing the function $$\mathrm{Log}\left(\frac{1}{X}\right).$$

Further, to assure the metal-oxide semiconductor (MOS) operates in a weak inversion forward saturation, the conditions $I_D \leq I_{D0}$, and $V_{DS} \geq 4U_T$ must be satisfied, for example.

Figure 4:
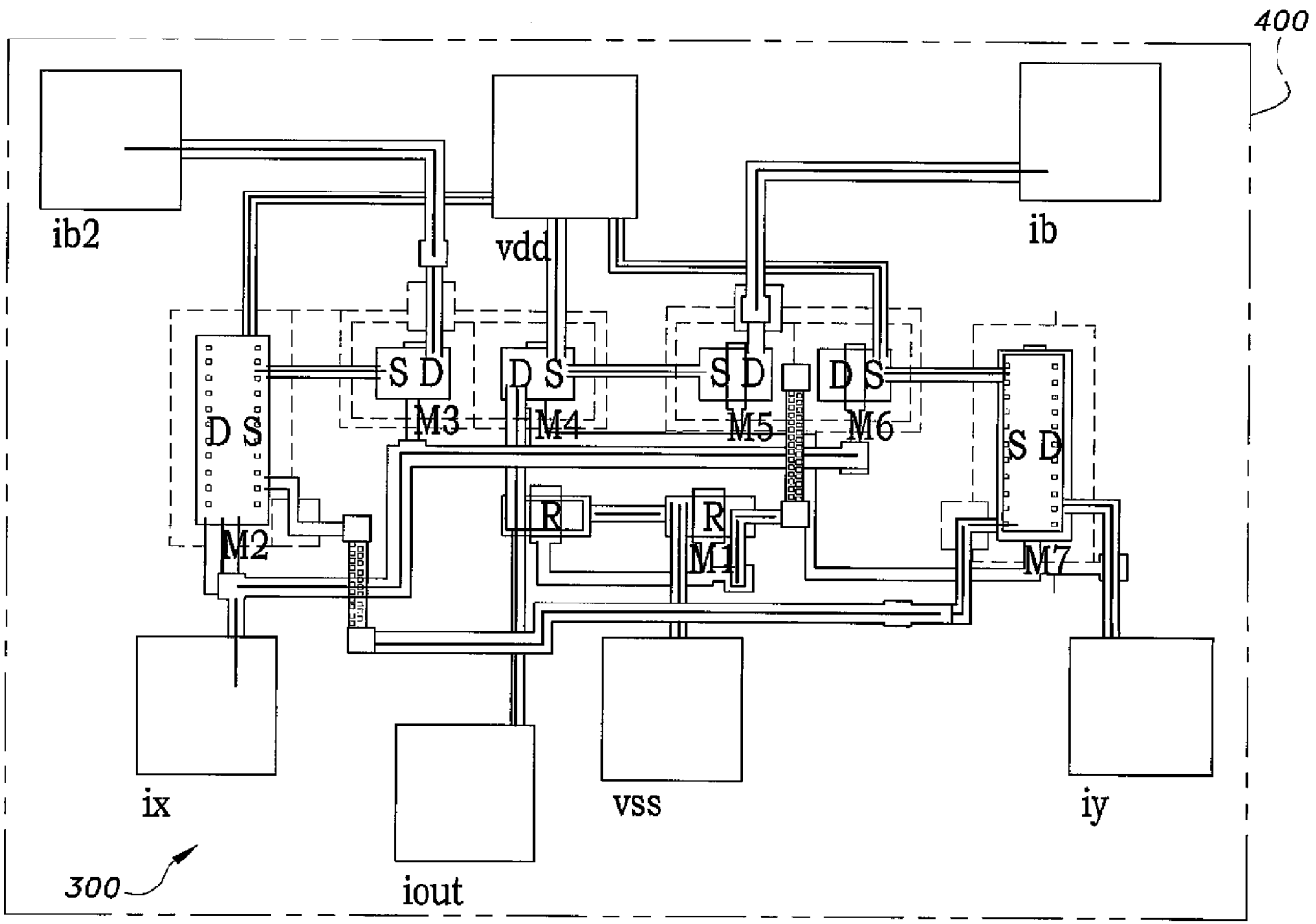
FIG. 4 is the layout of an embodiment of a CMOS logarithmic current generator circuit according to the present invention.

FIG. 4 is a layout 400 of an embodiment of the CMOS logarithmic current generator circuit 300. The layout and post layout simulation for an embodiment of a CMOS logarithmic current generator circuit was carried out using a Tanner tool in 0.35 μm 2p4m Taiwan Semiconductor Manufacturing Company (TSMC) process. The layout 400 of the embodiment of the CMOS logarithmic current generator circuit 300 is shown in FIG. 4. The simulation results were obtained for $I_b$=30 nA, $I_x$=125 nA and VDD=−VSS=0.5V. The transistors' aspect ratios in the embodiment of the CMOS logarithmic current generator circuit 300 in the layout 400 are listed in Table 1.

TABLE 1

Aspect Ratios of Transistors

| Transistor | Aspect Ratios width/length (W/L) |
|---|---|
| M1-M2 | 1.4 μm/0.35 μm |
| M3-M4 | 6.3 μm/0.35 μm |
| M5-M6 | 1.4 μm/0.35 μm |
| M7-M8 | 1 μm/1 μm |

Figure 5:
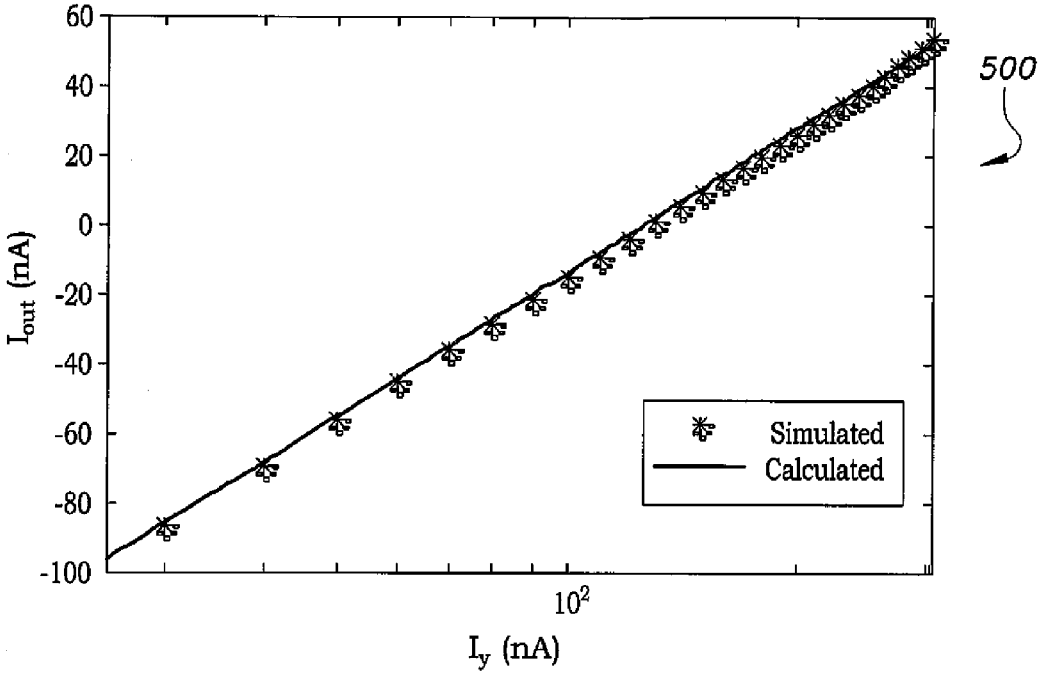
FIG. 5 is a plot of simulated and calculated results of an input current versus an output current in an embodiment of a CMOS logarithmic current generator circuit according to the present invention.

The output current was measured by forcing it through a grounded load $R_L$=1 kΩ. The current $I_x$=125 nA, and the input current $I_y$ was varied from 20 nA to 400 nA. The measured output dynamic range is around 150 nA. The simulated and calculated results are shown in plot 500 of FIG. 5 which uses a log scale. The plot 500 shows that the simulated result is in substantial agreement with the theory and confirms the functionality of the CMOS logarithmic current generator circuit design. Moreover, the plot 500 shows the output current is zero for $I_y$=$I_x$=125 nA. It was found that the maximum linearity error is 4% and the maximum power consumption is 0.3 μW.

Figure 6:
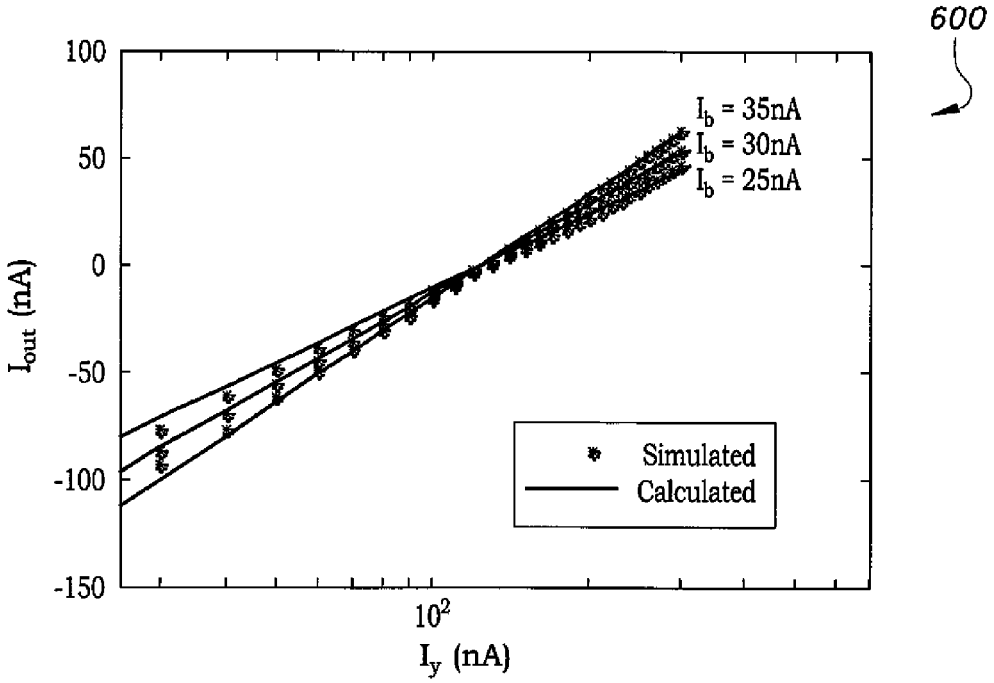
FIG. 6 is a plot showing gain variability using a bias current in an embodiment of a CMOS logarithmic current generator circuit according to the present invention.

The CMOS logarithmic current generator circuit was simulated for different values of the bias current $I_b$ and the corresponding output current is shown in plot 600 of FIG. 6. It is evident from the plot 600 that the circuit gain is controllable.

Figure 7:
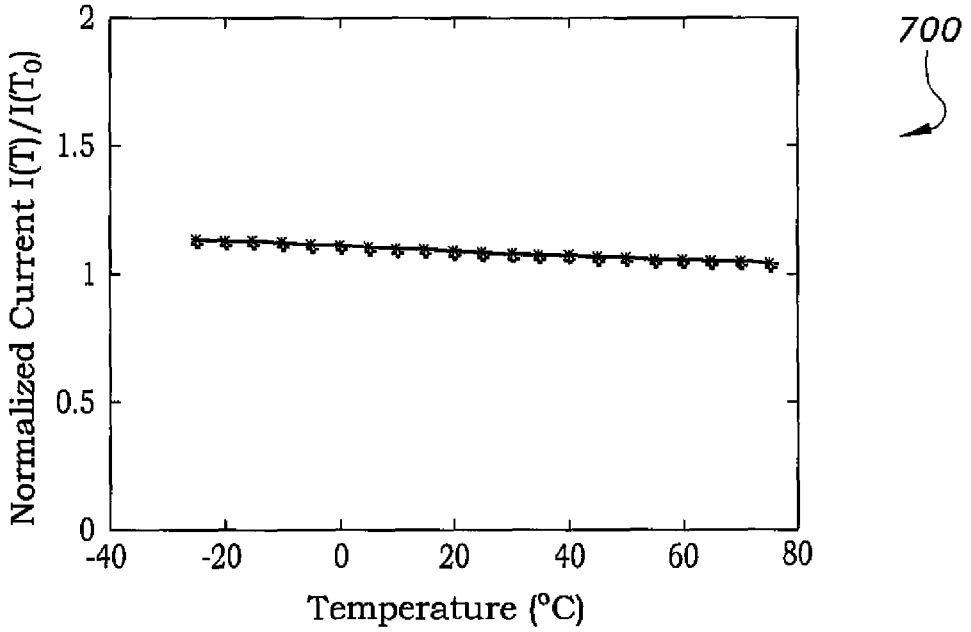
FIG. 7 is a plot showing the effect of temperature change on an embodiment of a CMOS logarithmic current generator circuit according to the present invention.

The temperature insensitivity of the CMOS logarithmic current generator circuit design has been confirmed by simulation. The temperature was varied from −25° C. to +75° C. The output current of the CMOS logarithmic current generator circuit was normalized to its current at T=+25° C. Plot 700 shows simulation results in FIG. 7. It is clear from the plot 700 that the output current is substantially insensitive to temperature.

Figure 8:
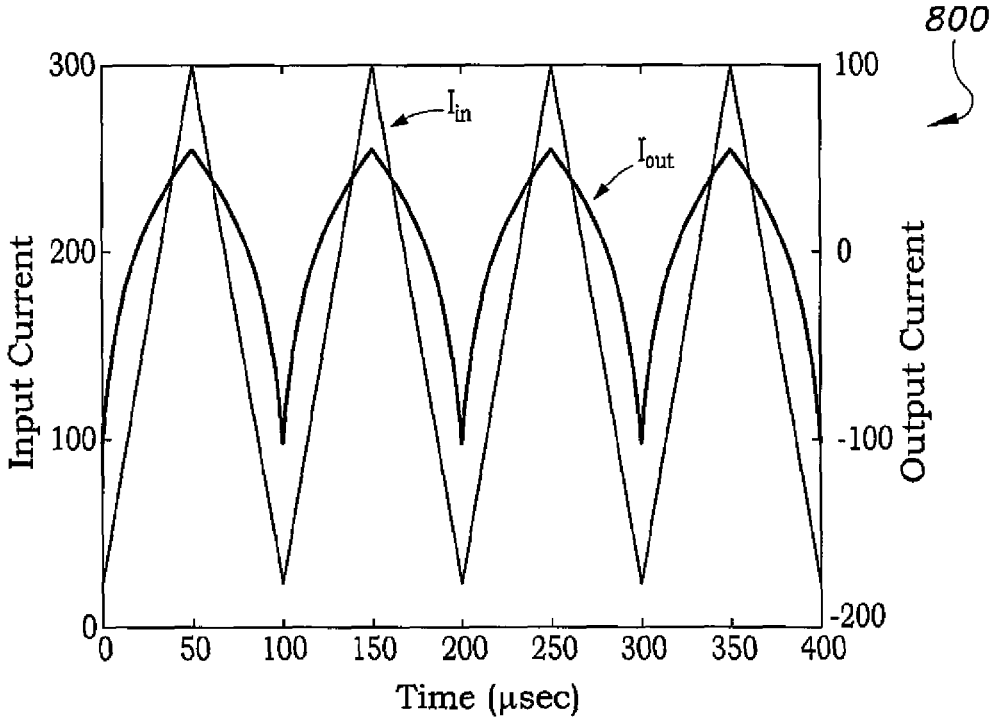
FIG. 8 is a plot showing the transient response of an embodiment of a CMOS logarithmic current generator circuit according to the present invention.
Figure 9:
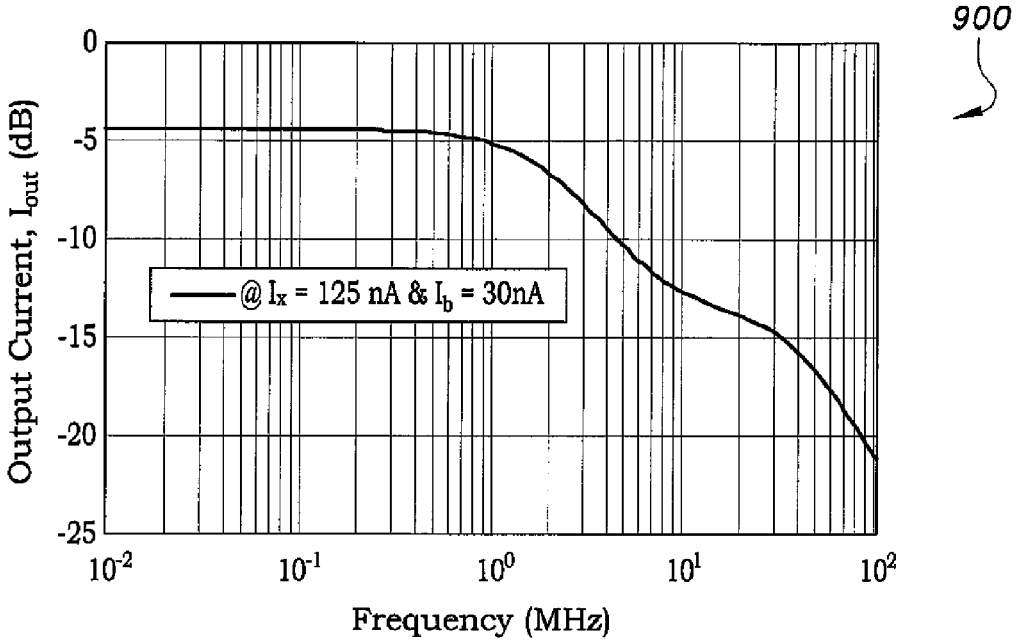
FIG. 9 is a plot showing the frequency response of an embodiment of a CMOS logarithmic current generator circuit according to the present invention.
Figure 10:
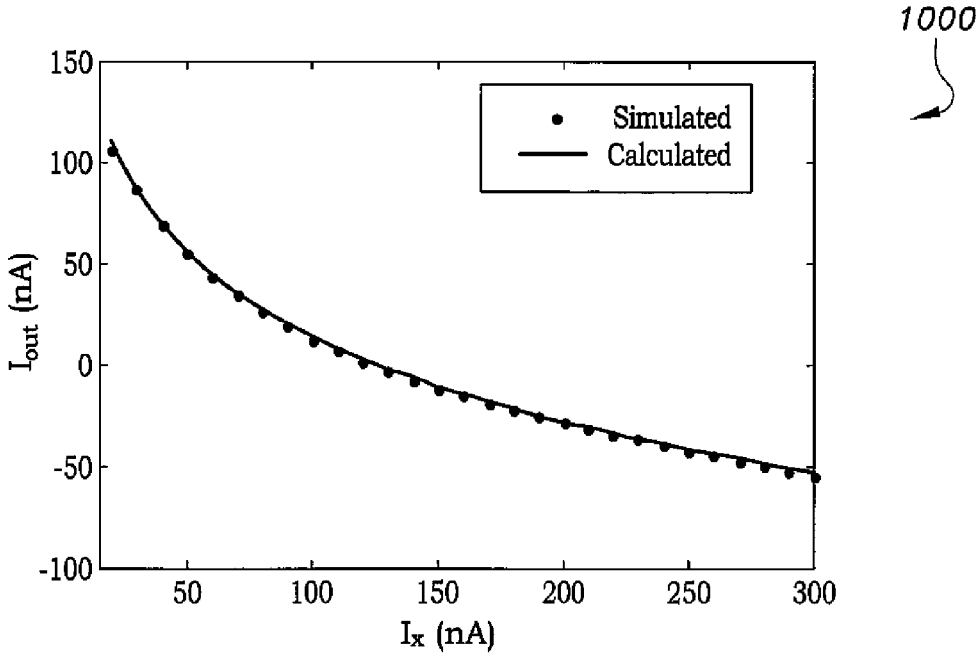
FIG. 10 is a plot showing simulation results for log(1/x) of an embodiment of a CMOS logarithmic current generator circuit according to the present invention.

The circuit transient response of the CMOS logarithmic current generator circuit was also found for a triangular signal shifted by a 40 nA direct current (DC) component. The simulation result shown in plot 800 of FIG. 8 confirms the functionality of the CMOS logarithmic current generator circuit. The CMOS logarithmic current generator circuit was also simulated for frequency response. The −3 dB bandwidth is found to be 5.7 MHz as shown in plot 900 of FIG. 9. The CMOS logarithmic current generator circuit can be used to implement for $$\mathrm{Log}\left(\frac{1}{X}\right)$$

at a constant or substantially constant current $I_Y$. Simulation result for this function is shown in plot 1000 of FIG. 10.

Figure 11:
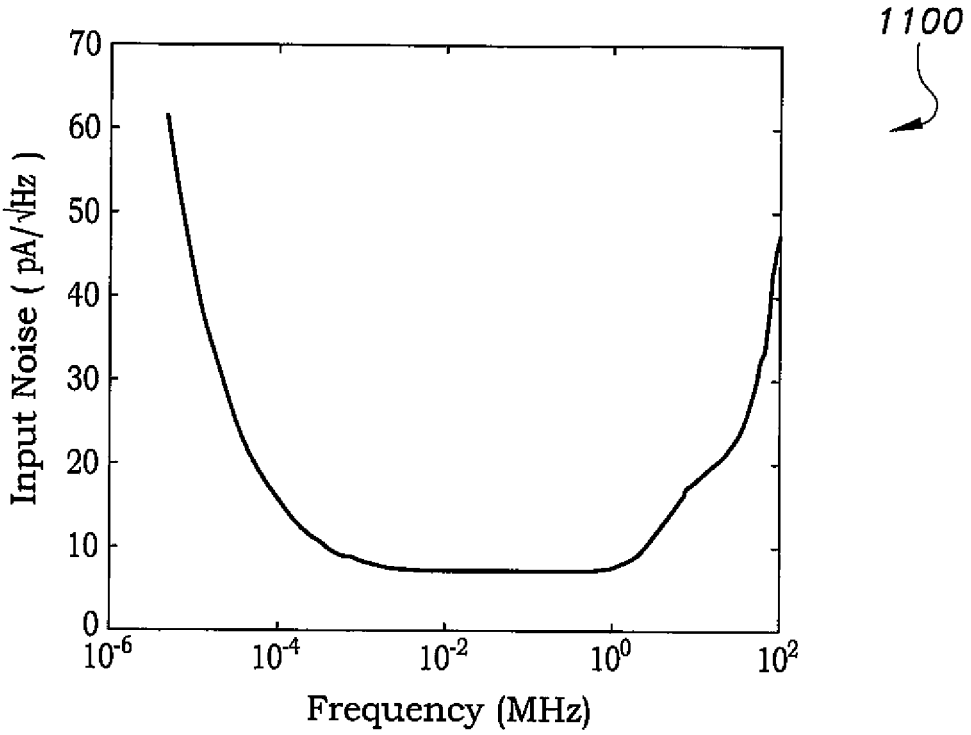
FIG. 11 is a plot showing input noise as a function of frequency of an embodiment of a CMOS logarithmic current generator circuit according to the present invention.
Figure 12:
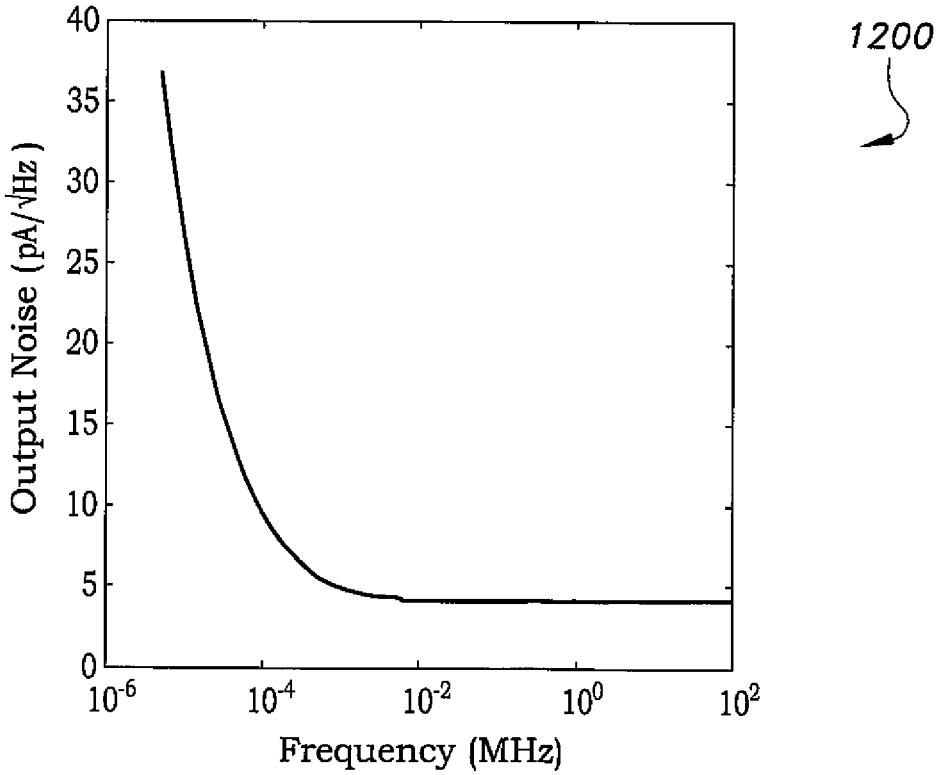
FIG. 12 is a plot showing output noise as a function of frequency of an embodiment of a CMOS logarithmic current generator circuit according to the present invention.

Simulation for noise analysis on the CMOS logarithmic current generator circuit was carried out. The equivalent noise at the input terminal is shown in plot 1100 of FIG. 11. The equivalent noise at the output terminal is shown in plot 1200 of FIG. 12. The simulation was carried out with the input DC and small signals equal to 100 nA and 50 nA, respectively, and also a 1 kΩ resistor was attached to the output as a load, for example. It is evident from the plots 1100 and 1200 that noise suppression can be achieved by around 50%.

The performance of the CMOS logarithmic current generator design is summarized in Table 2. It is apparent from the Table 2 that the CMOS logarithmic current generator circuit design has parameters and parametric features that can address the various problems previously outlined as can be present in existing types of CMOS current-mode logarithmic circuits.

TABLE 2

Performance of the CMOS Logarithmic Current Generator

| Parameter | CMOS Logarithmic Current Generator |
|---|---|
| Technology (Process) | 0.35 μm CMOS |
| Operation Region | Sub threshold |
| Voltage Supply | ±0.5 V |
| Input\output | Current-current |
| Power dissipation | 0.3 μW |
| Gain controllability | Yes |
| True for x ≥ 1 or x < 1 | Satisfied |
| Temperature | Not sensitive |

Embodiments of CMOS logarithmic current generator circuits can produce a relatively highly accurate logarithmic function for any value of $I_y$ larger or smaller than $I_x$. The performance of the CMOS logarithmic current generator circuit has been verified using Tanner Tools with a 0.35 μm CMOS process. The CMOS logarithmic current generator circuit typically consumes around 0.3 μW and has a maximum linearity error of at or about 4% and −3 dB of 3.4 MHz, for example. The CMOS logarithmic current generator circuit can therefore be a useful building block in many analog signal processing applications, for example.

It is to be understood that the present invention is not limited to the embodiments described above, but encompasses any and all embodiments within the scope of the following claims.

We claim:

1. A complimentary metal-oxide semiconductor (CMOS) logarithmic current generator circuit, comprising:

a first metal-oxide semiconductor field-effect transistor (MOSFET) and a second MOSFET matched with each other and configured in the (CMOS) logarithmic current generator circuit as a first MOSFET pair biased in a weak inversion region to provide a first function generator core cell;

a third MOSFET and a fourth MOSFET matched with each other and configured in the (CMOS) logarithmic current generator circuit as a second MOSFET pair biased in the weak inversion region to provide a second function generator core cell;

a fifth MOSFET connected to a source voltage and the first function generator core cell, the fifth MOSFET contributing to an output current $I_{out}$ of the CMOS logarithmic current generator circuit;

a sixth MOSFET connected to the source voltage and the second function generator core cell, the sixth MOSFET contributing to the output current $I_{out}$ of the CMOS logarithmic current generator circuit;

a seventh MOSFET in operable communication with the first function generator core cell, the seventh MOSFET providing an input current $I_X$ to the CMOS logarithmic current generator circuit to produce a corresponding first voltage $V_A$; and an eighth MOSFET in operable communication with the second function generator core cell, the eighth MOSFET providing an input current $I_Y$ to the CMOS logarithmic current generator circuit to produce a corresponding second voltage $V_B$, wherein the first function generator core cell and the second function generator core cell are each biased by a biasing current $I_b$ that varies based upon the first voltage $V_A$ and the second voltage $V_B$ applied to the first function generator core cell and the second function generator core cell, the first voltage $V_A$ being determined by the input current $I_X$ and the second voltage $V_B$ being determined by the input current $I_Y$, wherein the weak inversion region is defined by a current, $I_2$, where $$I_2 = I_b \cdot \exp\left[\frac{(V_A - V_B)}{nU_T}\right],$$

where n is a weak inversion slope factor and $U_T$=KbT/q, where Kb is Boltzmann's constant, q is electron charge, and T represents temperature, and wherein the CMOS logarithmic current generator circuit provides the output current $I_{out}$ based upon a current mode logarithmic function defined by the relation:

$$I_{out} = 2I_b \cdot \ln\left(\frac{I_Y}{I_X}\right).$$

2. The CMOS logarithmic current generator circuit according to claim 1, wherein the output current $I_{out}$ is proportional to a logarithm of the input current $I_Y$ when the input current $I_X$ is maintained substantially constant.

3. The CMOS logarithmic current generator circuit according to claim 1, wherein a gain of the output current $I_{out}$ is controlled by the biasing current $I_b$.

4. The CMOS logarithmic current generator circuit according to claim 1, wherein the first MOSFET pair has an aspect ratio of a width/length (WL) of 1.4 μm/0.35 μm, the second MOSFET pair has an aspect ratio (WL) of 1.4 μm/0.35 μm, the seventh $I_x$, MOSFET and the eighth $I_y$ MOSFET have an aspect ratio (WL) of 6.3 μm/0.35 μm, and the fifth and sixth source voltage MOSFETS have an aspect ratio (WL) of 1 μm/1 μm.

5. A complimentary metal-oxide semiconductor (CMOS) logarithmic current generator circuit, comprising:

a first transistor pair biased in a weak inversion region, the first transistor pair comprising a first function generator core cell;

a second transistor pair biased in the weak inversion region, the second transistor pair comprising a second function generator core cell;

a first input current transistor in operable communication with the first function generator core cell, the first input current transistor providing a first input current $I_X$ to the CMOS logarithmic current generator circuit to produce a corresponding first voltage $V_A$; and a second input current transistor in operable communication with the second function generator core cell, the second input current transistor providing a second input current $I_Y$ to the CMOS logarithmic current generator circuit to produce a corresponding second voltage $V_B$, wherein the first function generator core cell and the second function generator core cell are each biased by a biasing current $I_b$ that varies based upon the first voltage $V_A$ and the second voltage $V_B$ applied to the first function generator core cell and the second function generator core cell, the first voltage $V_A$ being determined by the first input current $I_X$ and the second voltage $V_B$ being determined by the second input current $I_Y$, wherein the weak inversion region is defined by a current, $I_2$, where $$I_2 = I_b \cdot \exp\left[\frac{(V_A - V_B)}{nU_T}\right],$$

where n is a weak inversion slope factor and $U_T$=KbT/q, where Kb is Boltzmann's constant, q is electron charge, and T represents temperature, and wherein the CMOS logarithmic current generator circuit provides an output current $I_{out}$ based upon a current mode logarithmic function defined by the relation:

$$I_{out} = 2I_b \cdot \ln\left(\frac{I_Y}{I_X}\right).$$

6. The CMOS logarithmic current generator circuit according to claim 5, wherein the output current $I_{out}$ is proportional to a logarithm of the second input current $I_Y$ when the first input current $_X$ is maintained substantially constant.

7. The CMOS logarithmic current generator circuit according to claim 5, wherein the first and second transistor pairs and the first and second input current transistors comprise metal-oxide semiconductor field-effect transistor (MOSFET) transistors.

8. The CMOS logarithmic current generator circuit according to claim 5, further comprising:

a first source voltage transistor connected to a source voltage and the first function generator core cell, the first source voltage transistor contributing to the output current $I_{out}$ of the CMOS logarithmic current generator circuit; and a second source voltage transistor connected to the source voltage and the second function generator core cell, the second source voltage transistor contributing to the output current $I_{out}$ of the CMOS logarithmic current generator circuit.

9. The CMOS logarithmic current generator circuit according to claim 8, wherein the first and second transistor pairs, the first and second input current transistors and the first and second source voltage transistors comprise metal-oxide semiconductor field-effect transistor (MOSFET) transistors.

10. The CMOS logarithmic current generator circuit according to claim 5, wherein a gain of the output current $I_{out}$ is controlled by the biasing current $I_b$.

11. A method for generating a logarithmic current, comprising the steps of:

biasing a first transistor pair comprising a first function generator core cell in a weak inversion region;

biasing a second transistor pair comprising a second function generator core cell in the weak inversion region;

receiving a first input current $I_X$ by a complimentary metal-oxide semiconductor (CMOS) logarithmic current generator circuit, the CMOS logarithmic current generator circuit comprising the first and second function generator core cells, and producing a corresponding a first voltage $V_A$;

receiving a second input current $I_Y$ by the CMOS logarithmic current generator circuit and producing a corresponding second voltage $V_B$;

generating a biasing current $I_b$, that varies based upon the first voltage $V_A$ and the second voltage $V_B$ applied to the first function generator core cell and the second function generator core cell, the first voltage $V_A$ being determined by the first input current $I_X$ and the second voltage $V_B$ being determined by the second input current $I_Y$, wherein the weak inversion region is defined by a current, $I_2$, where $$I_2 = I_b \cdot \exp\left[\frac{(V_A - V_B)}{nU_T}\right],$$

where n is a weak inversion slope factor and $U_T$=KbT q, where Kb is Boltzmann's constant, q is electron charge, and T represents temperature; and providing by the CMOS logarithmic current generator circuit an output current $I_{out}$ based upon a current mode logarithmic function defined by the relation:

$$I_{out} = 2I_b \cdot \ln\left(\frac{I_Y}{I_X}\right).$$

12. The method for generating a logarithmic current according to claim 11, further comprising the step of:

maintaining the first input current $_X$ to the CMOS logarithmic current generator circuit substantially constant, wherein the output current $I_{out}$ is proportional to a logarithm of the second input current $I_Y$ when the first input current $I_X$ is maintained substantially constant.

13. The method for generating a logarithmic current according to claim 11, further comprising the step of:

controlling a gain of the output current $I_{out}$ by the biasing current $I_b$.

14. The method for generating a logarithmic current according to claim 11, wherein the CMOS logarithmic current generator circuit comprises metal-oxide semiconductor field-effect transistor (MOSFET) transistors.

* * * * *